US009726011B2

(12) United States Patent
Sugiura

(10) Patent No.: US 9,726,011 B2
(45) **Date of Patent: *Aug. 8, 2017**

(54) DOWNLINKING COMMUNICATION SYSTEM AND METHOD

(71) Applicant: Schlumberger Technology Corporation, Sugar Land, TX (US)

(72) Inventor: Junichi Sugiura, Bristol (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 662 days.

This patent is subject to a terminal disclaimer.

(21) Appl. No.: 14/053,355

(22) Filed: Oct. 14, 2013

(65) Prior Publication Data

US 2014/0036629 A1 Feb. 6, 2014

Related U.S. Application Data

(63) Continuation of application No. 12/785,995, filed on May 24, 2010, now Pat. No. 8,570,833.

(51) Int. Cl.
*E21B 47/18* (2012.01)
*E21B 47/01* (2012.01)

(52) U.S. Cl.
CPC ..... *E21B 47/185* (2013.01); *E21B 47/011* (2013.01)

(58) Field of Classification Search
CPC ..... G01V 3/00; E21B 47/18
USPC ..... 340/853.3, 853.6, 855.4, 855.5; 367/83
See application file for complete search history.

(56) References Cited

U.S. PATENT DOCUMENTS

| | | | |
|---|---|---|---|
| 3,298,449 | A | 1/1967 | Bachman et al. |
| 4,354,233 | A | 10/1982 | Zhukovsky et al. |
| 4,655,299 | A | 4/1987 | Schoeffler |
| 4,903,245 | A | 2/1990 | Close et al. |
| 5,065,825 | A | 11/1991 | Bardin et al. |
| 5,113,379 | A | 5/1992 | Scherbatskoy |
| 5,115,415 | A | 5/1992 | Mumby et al. |
| 5,182,730 | A | 1/1993 | Scherbatskoy |
| 5,215,152 | A | 6/1993 | Duckworth |
| 5,357,483 | A | 10/1994 | Innes |
| 5,603,386 | A | 2/1997 | Webster |

(Continued)

FOREIGN PATENT DOCUMENTS

| | | | |
|---|---|---|---|
| GB | 2172324 | A | 9/1986 |
| GB | 2177738 | A | 1/1987 |

(Continued)

OTHER PUBLICATIONS

Jones, et al., "Concurrent Rotary-Steerable Directional Drilling and Hole Enlargement Applied Successfully: Case Studies in North Sea, Mediterranean Sea, and Nile Delta", SPE 112670—IADC/SPE Drilling Conference, Orlando, Florida, USA, Mar. 4-6, 2008, pp. 1-15.

(Continued)

*Primary Examiner* — Albert Wong

(57) ABSTRACT

A downlinking signal is transmitted downhole from the surface using drilling fluid as the communications medium. The downlinking signal includes at least a synchronization phase and a command phase. Attributes of the synchronization phase are used upon reception of the signal to determine corresponding attributes of the command phase. Commands may be transmitted downhole while drilling and simultaneously while using mud-pulse telemetry uplinking techniques.

19 Claims, 7 Drawing Sheets

(56) References Cited

U.S. PATENT DOCUMENTS

| | | | |
|---|---|---|---|
| 5,787,052 | A | 7/1998 | Gardner et al. |
| 5,963,138 | A | 10/1999 | Gruenhagen |
| 6,021,377 | A | 2/2000 | Dubinsky et al. |
| 6,105,690 | A | 8/2000 | Biglin, Jr. et al. |
| 6,219,301 | B1 | 4/2001 | Moriarty |
| 6,267,185 | B1 | 7/2001 | Mougel et al. |
| 6,662,110 | B1 | 12/2003 | Bargach et al. |
| 6,714,138 | B1 | 3/2004 | Turner et al. |
| 6,920,085 | B2 | 7/2005 | Finke et al. |
| 7,026,950 | B2 | 4/2006 | Guggari et al. |
| 7,114,579 | B2 | 10/2006 | Hutchinson |
| 7,142,986 | B2 | 11/2006 | Moran |
| 7,172,037 | B2 | 2/2007 | Dashevskiy et al. |
| 7,222,681 | B2 | 5/2007 | Jones et al. |
| 7,245,229 | B2 | 7/2007 | Baron et al. |
| 7,426,967 | B2 | 9/2008 | Sugiura |
| 7,518,950 | B2 | 4/2009 | Treviranus et al. |
| 7,983,113 | B2 | 7/2011 | Krueger et al. |
| 8,408,331 | B2 | 4/2013 | Patwa et al. |
| 2003/0016164 | A1 | 1/2003 | Finke et al. |
| 2004/0217879 | A1 | 11/2004 | Guggari et al. |
| 2005/0001737 | A1 | 1/2005 | Baron et al. |
| 2005/0209782 | A1 | 9/2005 | Moriarty |

FOREIGN PATENT DOCUMENTS

| | | | |
|---|---|---|---|
| GB | 2282165 | A | 3/1995 |
| GB | 2356207 | A | 5/2001 |
| GB | 2358651 | A | 8/2001 |
| WO | 90/07625 | A1 | 7/1990 |
| WO | 90/08245 | A1 | 7/1990 |
| WO | 01/11191 | A1 | 2/2001 |

OTHER PUBLICATIONS

Jones, et al., "Results From Systematic Rotary-Steerable Testing With PDC Drill-Bits Depict the Optimal Balance Between Stability, Steerability, and Borehole Quality", SPE 112579—IADC/SPE Drilling Conference, Orlando, Florida, USA, Mar. 4-6, 2008, pp. 1-14.

Sugiura, et al., "Integrated Approach to Rotary-Steerable Drilling Optimization Using Concurrent Real-time Measurement of Near-bit Borehole Caliper and Near-bit Vibration", SPE 112163—Intelligent Energy Conference and Exhibition, Amsterdam, The Netherlands, Feb. 25-27, 2008, pp. 1-19.

Sugiura, et al., "The Use of the Industry's First 3-D Mechanical Caliper Image While Drilling Leads to Optimized Rotary-Steerable Assemblies in Push- and Point-the-Bit Configurations", SPE 115395—SPE Annual Technical Conference and Exhibition, Denver, Colorado, USA, Sep. 21-24, 2008, pp. 1-12.

Sugiura, Junichi , "The Use of the Near-bit Vibration Sensor While Drilling Lead to Optimized Rotary-Steerable Drilling in Push- and Point-the-Bit Configurations", SPE 115572—SPE Asia Pacific Oil and Gas Conference and Exhibition, Perth, Australia, Oct. 20-22, 2008, pp. 1-10.

Sugiura, Junichi , "Improving Rotary-Steerable Borehole Quality Using Innovative Imaging Techniques", OTC 19991—Offshore Technology Conference, Houston, Texas, May 4-7, 2009, pp. 1-10.

DOWNLINKING COMMUNICATION SYSTEM AND METHOD

RELATED APPLICATIONS

This application is a Continuation of co-pending, commonly-invented, and commonly-assigned U.S. patent application Ser. No. 12/785,995 filed May 24, 2010 and entitled Down Linking Communication System and Method.

FIELD OF THE INVENTION

The present invention relates generally to a downlinking system for transmitting data and/or commands from the surface to a downhole tool deployed in a drill string. Exemplary embodiments of this invention relate to a downlinking method in which a downlinking signal includes at least a synchronization phase and a command phase.

BACKGROUND OF THE INVENTION

Oil and gas well drilling operations commonly make use of logging while drilling (LWD) sensors to acquire logging data as the well bore is being drilled. This data may provide information about the progress of the drilling operation or the earth formations surrounding the well bore. Significant benefit may be obtained by improved control of downhole sensors from the rig floor or from remote locations. For example, the ability to send commands to downhole sensors that selectively activate the sensors can conserve battery life and thereby increase the amount of downhole time a sensor is useful.

Directional drilling operations are particularly enhanced by improved control. The ability to efficiently and reliably transmit commands from an operator to downhole drilling hardware may enhance the precision of the drilling operation. Downhole drilling hardware that, for example, deflects a portion of the drill string to steer the drilling tool is typically more effective when under tight control by an operator. The ability to continuously adjust the projected direction of the well path by sending commands to a steering tool may enable an operator to fine tune the projected well path based on substantially real-time survey and/or logging data. In such applications, both accuracy and timeliness of data transmission are clearly advantageous.

Prior art communication techniques that rely on the rotation rate of the drill string to encode data are known. For example U.S. Pat. No. 5,603,386 to Webster discloses a method in which the absolute rotation rate of the drill string is utilized to encode steering tool commands. U.S. Pat. No. 7,245,229 to Baron et al discloses a method in which a difference between first and second rotation rates is used to encode steering tool commands. U.S. Pat. No. 7,222,681 to Jones et al discloses a method in which steering tool commands and/or data may be encoded in a sequence of varying drill string rotation rates and drilling fluid flow rates. The varying rotation rates and flow rates are measured downhole and processed to decode the data and/or the commands.

While drill string rotation rate encoding techniques are commercially serviceable, there is room for improvement in certain downhole applications. For example, precise measurement of the drill string rotation rate can become problematic in deep and/or horizontal wells or when stick/slip conditions are encountered. Rotation rate encoding also commonly requires the drilling process to be interrupted and the drill bit to be lifted off bottom. Therefore, there exists a need for improved methods and systems for downlinking data and/or commands downhole.

SUMMARY OF THE INVENTION

The present invention addresses the need for an improved downlinking method and system for downhole tools. Aspects of the invention include a method for downlinking instructions from a surface location to a downhole tool such as a steering tool. A downlinking signal is transmitted downhole using drilling fluid as the communications medium. The downlinking signal includes at least a synchronization phase and a command phase. Attributes of the synchronization phase are used upon reception at the downhole tool to determine corresponding attributes of the command phase. For example, the synchronization phase may be configured to specify at least one of a bit length and a pulse level of the encoded command.

Exemplary embodiments of the present invention may advantageously provide several technical advantages. For example, the present invention advantageously enables the base flow rate, the pulse flow rate, and the bit length to be determined adaptively while drilling. The base flow rate may be selected, for example, for optimum drilling performance, while the pulse flow rate and the bit length may be selected on the fly based upon the signal condition (e.g., the bit length may be increased with increasing measured depth so as to improve the signal to noise ratio).

The present invention tends to be further advantageous in that the downlinking method does not require interruption of the drilling process. Commands may be transmitted downhole while drilling (i.e., while the drill bit is rotating on-bottom). Moreover, the present invention advantageously utilizes a distinct frequency channel as compared to conventional mud pulse telemetry and may therefore be simultaneously used with mud-pulse telemetry techniques (i.e., data may be transmitted downhole using the present invention at the same time data is being transmitted uphole using conventional mud pulse telemetry). These features of the invention can save considerable rig time.

In one aspect the present invention includes a method for transmitting a command from a surface location to a bottom hole assembly located in a borehole. The method includes pumping drilling fluid downhole through a drill string to the bottom hole assembly and changing a flow rate of the drilling fluid to encode a downlinking signal. The downlinking signal includes at least a synchronization phase and a command phase each of which includes at least one distinct pulse. The method further includes detecting the downlinking signal at the bottom hole assembly, decoding the synchronization phase to determine at least one of a bit length and a pulse level of the command phase, and decoding the command phase to determine the command based on the bit length and the pulse level determined from the synchronization phase.

In another aspect the present invention includes a system for communicating at least one command from a surface location to a bottom hole assembly located in a borehole. The system includes a pump for pumping drilling fluid from the surface through a drill string to the bottom hole assembly and a flow control apparatus for controlling a flow rate of the drilling fluid such that the flow rate encodes a downlinking signal. The downlinking signal includes at least a synchronization phase and a command phase each of which includes at least one distinct flow rate pulse. The system further includes a downhole detector configured to detect the downlinking signal and a downhole controller configured to decode the downlinking signal. The controller is configured to (i) decode the synchronization phase to determine at least one of a bit length and a pulse level of the command phase and (ii) decode the command phase to determine the command.

The foregoing has outlined rather broadly the features of the present invention in order that the detailed description of the invention that follows may be better understood. Additional features and advantages of the invention will be described hereinafter which form the subject of the claims of the invention. It should be appreciated by those skilled in the art that the conception and the specific embodiments disclosed may be readily utilized as a basis for modifying or designing other methods, structures, and encoding schemes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
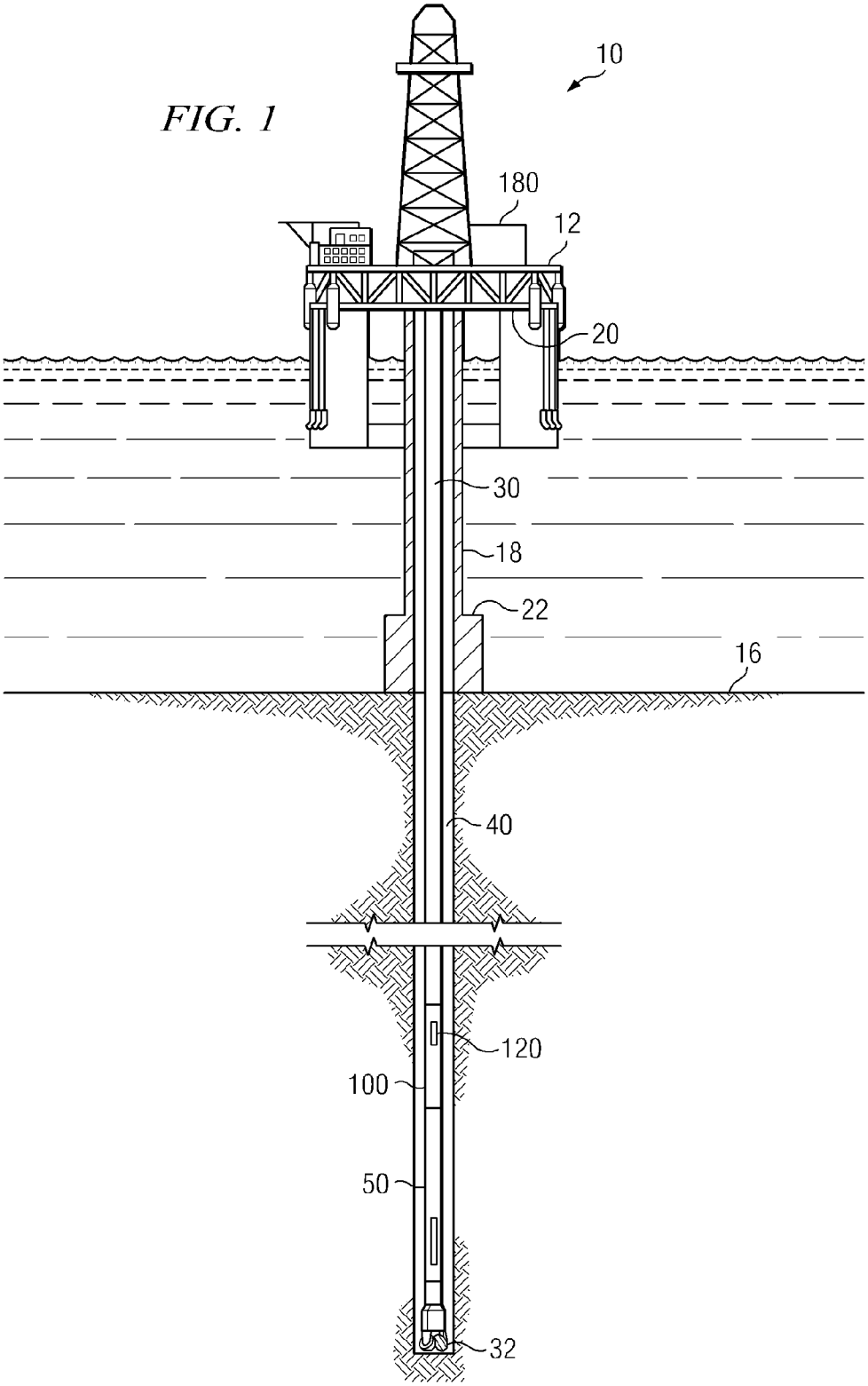
FIG. 1 depicts a drilling rig on which exemplary embodiments of the present invention may be deployed.

FIG. 1 illustrates a drilling rig 10 suitable for use with exemplary method and system embodiments in accordance with the present invention. In the exemplary embodiment shown on FIG. 1, a semisubmersible drilling platform 12 is positioned over an oil or gas formation (not shown) disposed below the sea floor 16. A subsea conduit 18 extends from deck 20 of platform 12 to a wellhead installation 22. The platform may include a derrick and a hoisting apparatus for raising and lowering the drill string 30, which, as shown, extends into borehole 40 and includes, for example, a drill bit 32, a steering tool 50, and a downhole tool 100. Drilling rig 10 includes a surface system 180 for controlling the pressure and/or flow rate of drilling fluid in the drill string 30 and thereby transmitting a signal including one or more commands (or data) downhole. The drilling rig 10 further includes a downlinking detector 120, for example, deployed on tool 100 for receiving the transmitted signaled. The downlinking detector 120 may be in electronic communication, for example, with the steering tool 50 and may be disposed to receive encoded commands from the surface and transmit those encoded commands to the steering tool 50 (although the invention is not limited to steering tool embodiments). The drill string 30 may also include various other electronic devices disposed to be in electronic communication with the downlinking detector 120, e.g., including a telemetry system, additional sensors (e.g., MWD and LWD sensors) for sensing downhole characteristics of the borehole and the surrounding formation, and microcontrollers deployed in other downhole measurement or logging tools. The invention is not limited in these regards.

It will be understood by those of ordinary skill in the art that methods and apparatuses in accordance with this invention are not limited to use with a semisubmersible platform 12 as illustrated in FIG. 1. This invention is equally well suited for use with any kind of subterranean drilling operation, either offshore or onshore. Moreover, it will also be understood that methods in accordance with this invention are not limited to communication with a steering tool 50 as illustrated in FIG. 1. The invention is also well suited for communicating with substantially any other downhole tools, including, for example, LWD and MWD tools and other downhole sensors. For example, aspects of this invention may be utilized to transmit commands and/or changes in commands from the surface to activate or deactivate an MWD or LWD sensor. Additionally, the invention may be utilized simultaneously and in combination with uplinking techniques (such as mud pulse telemetry). Furthermore, a combination of techniques may provide enhanced functionality, for example, in directional drilling applications in which data from various downhole sensors may be analyzed at the surface and used to adjust the desired trajectory of the borehole 40.

With continued reference to FIG. 1, it will be appreciated that the column of drilling fluid located in the drill string provides a physical medium for communicating information from the surface to downlinking detector 120. Although changes in flow rate may take time to traverse several thousand meters of drill pipe, the relative waveform characteristics of pulses including encoded data and/or commands are typically reliably preserved. For example, a sequence of flow rate pulses has been found to traverse a column of drilling fluid so as to reliably encode data and/or commands.

Figure 2:
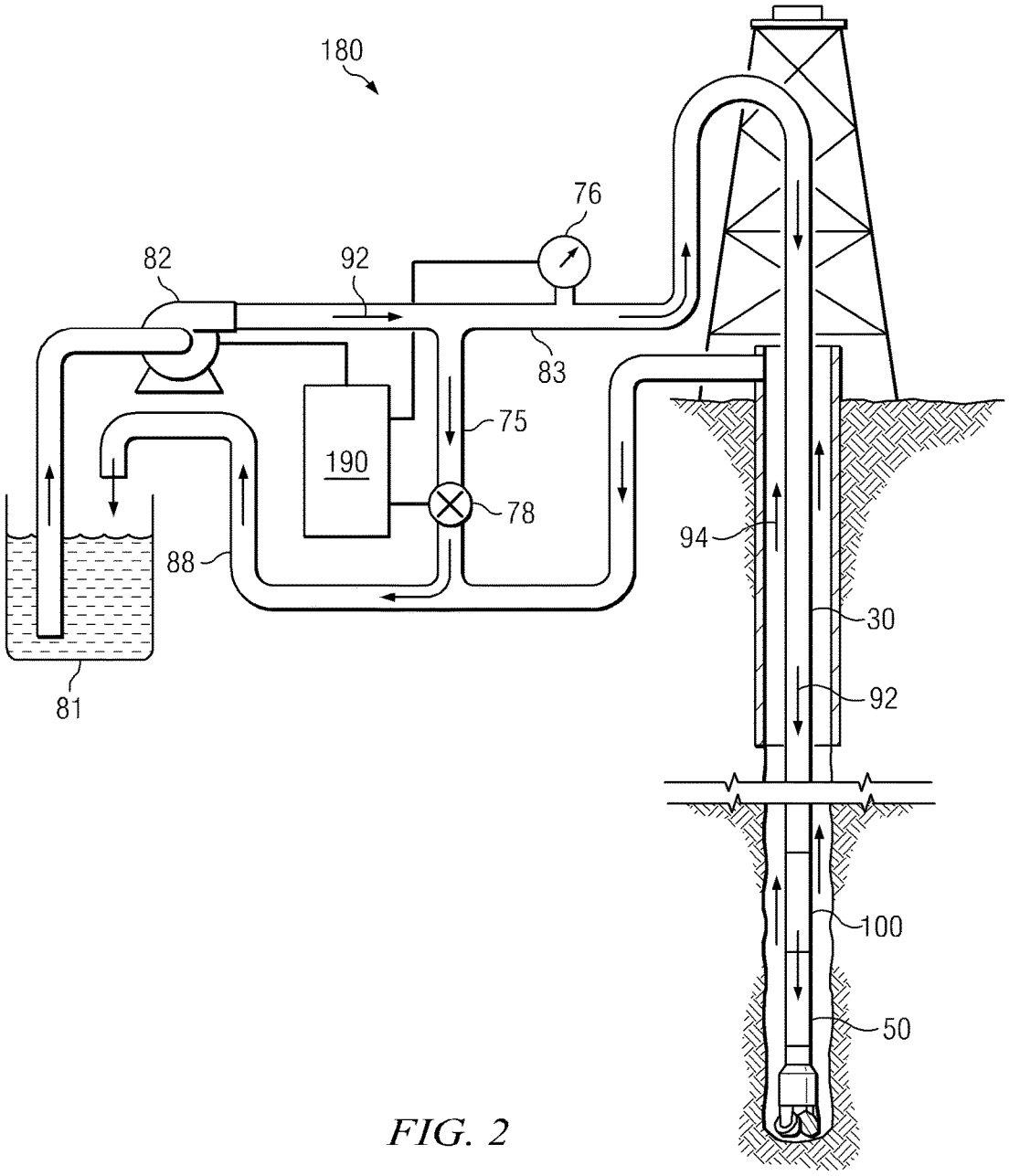
FIG. 2 depicts one exemplary embodiment of the surface system depicted on FIG. 1.

FIG. 2 depicts one exemplary embodiment of a surface system 180 in accordance with present invention. In the exemplary embodiment depicted, drilling fluid is pumped downhole (as depicted at 92) via a conventional mud pump 82. The drilling fluid may be pumped, for example, into a standpipe 83 and downward through the drill string 30. The drilling fluid typically emerges from the drill string at or near the drill bit and creates an upward flow 94 of mud through the borehole annulus (the space between the drill string and the borehole wall). The drilling fluid then flows through a return conduit 88 to mud pit 81.

An uphole controller 190 is configured to generate a signal, for example, a sequence of negative pressure (or fluid velocity) pulses in the drilling fluid. These pulses propagate downhole through the drilling fluid in the drill string and are received at downlinking detector 120. It will be appreciated that the signal may also be transmitted through the drilling fluid in the annulus. In one exemplary embodiment, the controller 190 may be in electronic communication with the pump 82. The signal (e.g., pressure or velocity pulses) may be generated, for example, via automatically changing the rotation speed of the pump (a negative pulse may be generated by momentarily reducing the rotation speed). The controller may also be in electronic communication with a sensor such as a pressure gauge or a flow meter. Such communication may provide a feedback mechanism for controlling the amplitude of the signal.

The controller may alternatively (and/or additionally) be in communication with a controllable valve 78 deployed in an optional bypass passageway 75. The bypass passageway 75 connects the standpipe 83 with the return 88 as depicted.

Those of ordinary skill in the art will appreciate that opening (or partially opening) value 78 allows drilling fluid to flow through the bypass 75 (thereby bypassing the borehole), which in turn reduces the pressure (and/or flow rate) of the drilling fluid in the drill string.

Surface system 180 may further (or alternatively) include a commercially available rig controller, for example, a DrillLink® remote control interface available from National Oilwell Varco. In computer controlled systems, an operator may input a desired flow rate, for example via a suitable user interface such as a keyboard or a touch screen. In one advantageous embodiment, system 180 may include a computerized system in which an operator inputs the data and/or the command to be transmitted. For example, for a downhole steering tool, an operator may input desired tool face and offset values (as described in more detail below). The controller 190 then determines a suitable sequence of flow rate pulses and executes the sequence to transmit the data and/or commands to the tool 100.

While FIG. 2 depicts a system suitable for automated control, it will be understood that the invention is not limited in this regard. Exemplary embodiments in accordance with the invention may likewise employ manual control schemes (e.g., the pump 82 and/or valve 78 may be manually actuated via known rheostatic control techniques). On drilling rigs including such manual control mechanisms, flow rate encoded data in accordance with this invention may be transmitted, for example, by manually adjusting the pump 82 or bypass valve 78 in consultation with a timer.

Figure 3A:
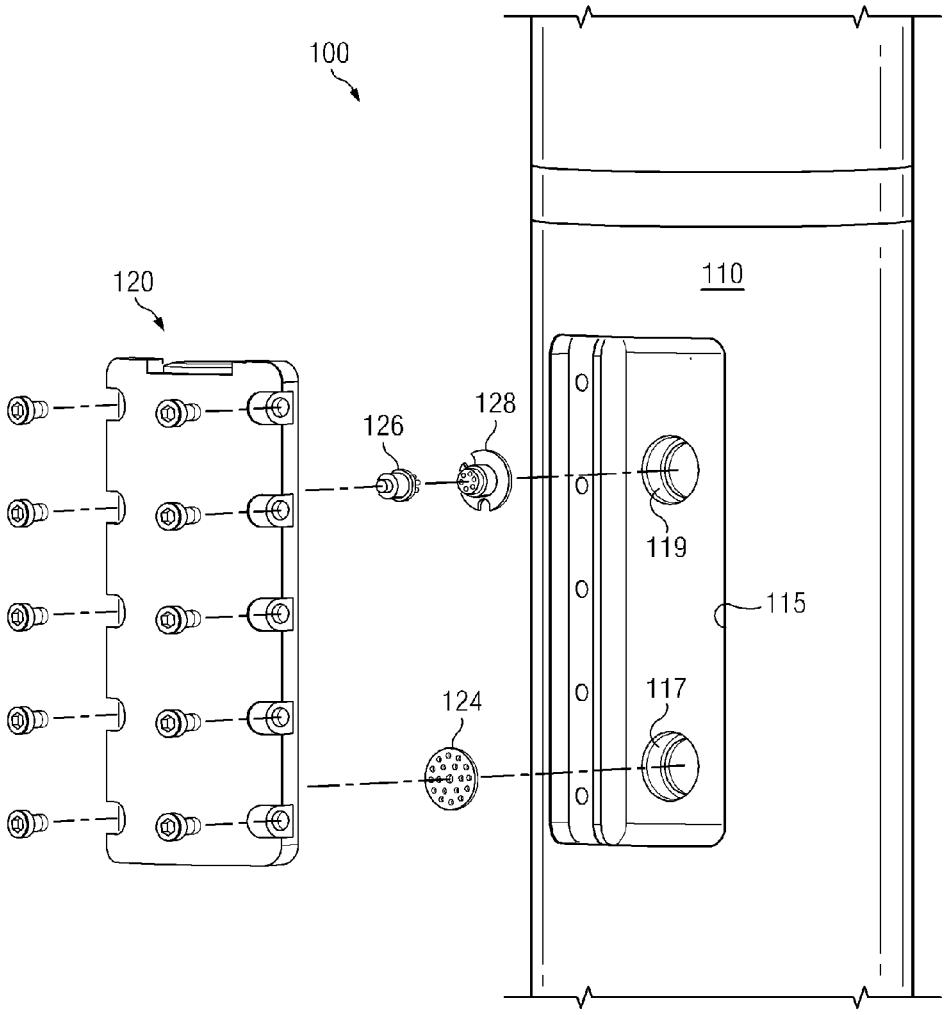
FIGS. 3A and 3B depict one exemplary embodiment of the downlinking detector depicted on FIG. 1.
Figure 3B:
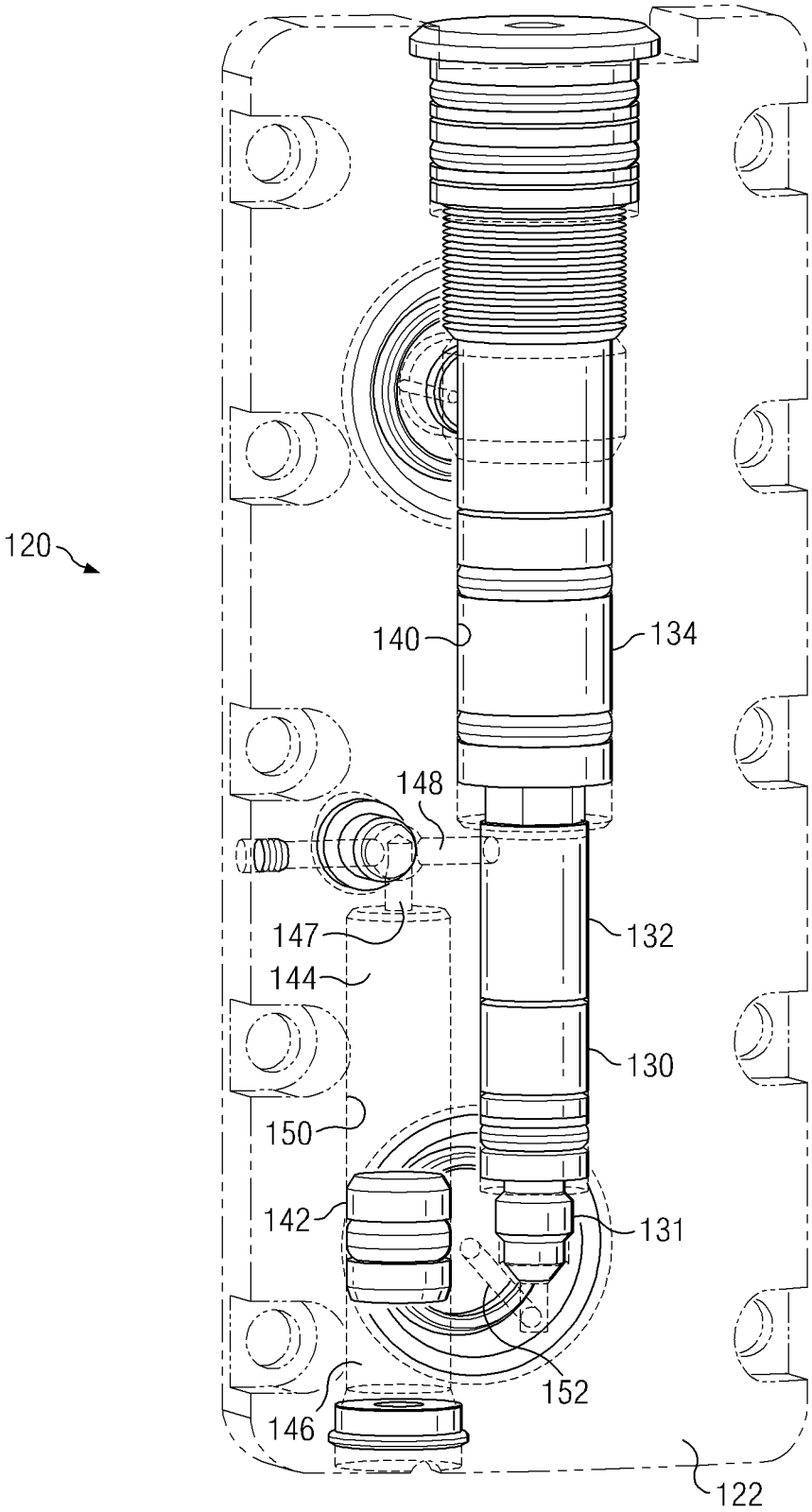

FIGS. 3A and 3B depict one exemplary embodiment of a downlinking detector 120 suitable for use with present invention. The exemplary embodiment depicted on FIGS. 3A and 3B is described in further detail in co-pending, commonly assigned U.S. patent application Ser. No. 12/684,205. In FIG. 3A a portion of downhole tool 100 is depicted in perspective view. In the exemplary embodiment shown, downhole tool 100 includes a substantially cylindrical downhole tool body 110 configured for connecting with the drill string. Downlinking detector 120 may be sealingly deployed in chassis slot 115. Chassis slot 115 includes first and second radial bores 117 and 119. Bore 117 provides for fluid communication with drilling fluid in a central bore (not shown) of the tool 100. A filter screen 124 may be deployed in bore 115 to minimize ingress of drilling fluid particulate into the downlinking detector 120. Bore 119 provides for electronic communication between the downlinking detector 120 and other components in the drill string, e.g., via electrical connectors 126 and 128.

As depicted on FIG. 3B, downlinking detector 120 may include a differential pressure transducer 130 deployed in a pressure housing 122. A differential transducer having a relatively low-pressure range (as compared to the drilling fluid pressure in the central bore of the tool 100) tends to advantageously increase the signal amplitude (and therefore the signal to noise ratio). In the exemplary embodiment depicted, differential transducer 130 is deployed in a first longitudinal bore 140 in pressure housing 122 and electrically connected with a pressure tight bulkhead 134, which is intended to prevent the ingress of drilling fluid from the differential transducer 130 into the electronics communication bore 119. In the exemplary embodiment depicted, a bulkhead 134 provides an electrical connection between transducer 130 and connector 126.

Differential transducer 130 is disposed to measure a difference in pressure between drilling fluid in the drill string and drilling fluid in the borehole annulus (hydrostatic pressure). Bore 152 provides high pressure drilling fluid from the drill string to a first side 131 (or front side) of the differential transducer 130. Bores 147 and 148 provide hydraulic oil (at hydrostatic pressure) to a second side 132 (or back side) of the differential transducer 130. The transducer 130 measures a pressure difference between these fluids (between the front and back sides of the differential transducer).

A compensating piston 142 is deployed in and sealingly engages a second longitudinal bore 150 in pressure housing 122. The bore 150 and piston 142 define first and second oil filled and drilling fluid filled fluid chambers 144 and 146. Chamber 146 is in fluid communication with drilling fluid in the borehole annulus (at hydrostatic well bore pressure). It will be readily understood to those of ordinary skill in the art that the drilling fluid in the borehole exerts a force on the compensating piston 142 proportional to the hydrostatic pressure in the borehole, which in turn pressurizes the hydraulic fluid in chamber 144.

While the exemplary embodiment of downlinking detector 120 depicted on FIGS. 3A and 3B includes a differential transducer, it will be understood that the invention is not limited in this regard. Downlinking detector 120 may include substantially any suitable sensors for receiving the signal, and may therefore alternatively and/or additionally include an absolute pressure sensor or a drilling fluid flow meter. Moreover, other measurements may be made to determine the pressure or drilling fluid velocity. For example turbine generator frequency or voltage may be correlated with drilling fluid velocity. Likewise, a motor rotation rate may also be correlated with the drilling fluid velocity. The invention is not limited in these regards.

It will further be understood that the drilling fluid velocity and the drilling fluid pressure (or differential pressure) are closely related quantities (they are essentially directly proportional to one another in the sub 1 Hertz frequency range of interest). Therefore measurement of one of these quantities is generally indicative of the other (e.g., a measurement of drilling fluid pressure is generally indicative of drilling fluid velocity and visa-versa). Likewise, the control of one these quantities at the surface tends also to control the other (e.g., control of drilling fluid velocity tends also to control drilling fluid pressure or differential pressure). As a result, certain embodiments of the invention may include controlling one parameter at the surface (e.g., velocity) and measuring the other downhole (e.g., differential pressure).

Those of skill in the art will further appreciate that downlinking detector 120 may further be utilized as a drill string or annular pressure while drilling measurement tool. For example, the differential pressure (measured via differential transducer 130) may be summed with an annular pressure measurement to obtain the pressure in the drill string. Likewise, the differential pressure may be subtracted from a drill string pressure measurement to obtain the annular pressure.

Figure 4:
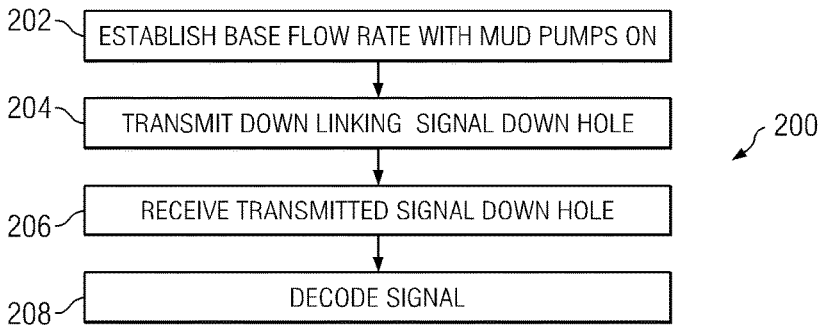
FIG. 4 depicts one exemplary method embodiment in accordance with the present invention.

Turning now to FIG. 4 one exemplary method embodiment 200 in accordance with the present invention is depicted. At 202 drilling fluid is pumped downhole from the surface and a base drilling fluid flow rate is established. The base flow rate may be established while the drill bit is on bottom (i.e., during drilling) or off bottom. At 204 a downlinking signal is transmitted downhole from the surface through the drilling fluid. The signal may be generated, for example, via modulating the pressure and/or flow rate of the drilling fluid being pumped downhole. In one preferred embodiment, the signal includes a plurality of spaced apart negative pressure and/or flow rate pulses. As described in more detail below, the signal includes at least synchronization and command phases. At 206, the transmitted signal is received downhole, e.g., via downlinking detector 120. The signal may then be decoded at 208.

When the drilling fluid pumps are turned off (e.g., when a new section of drill pipe is attached to the drill string) the differential transducer indicates a zero level (in analog to digital raw counts). This value is stored as a zero pressure reference level. In exemplary embodiments of the invention, the zero level may be accurately sampled at periodic intervals during drilling. After turning on the mud pumps at 202, a full flow rate level may be established when the flow rate stabilizes (e.g., after a predetermined period such as 30 seconds). A negative pulse value (or threshold) may be computed from the base and zero levels, for example as follows:

$$PT=Base-R\cdot(Base-Zero) \quad \text{Equation 1}$$

where PT represents the pulse threshold in ADC counts, Base represents the base level counts, Zero represents the zero level counts, and R represents a predetermined flow reduction rate for a negative pressure pulse (e.g., a pressure pulse having a 15, 20, or 25% reduction in flow rate from the base level).

Figure 5A:
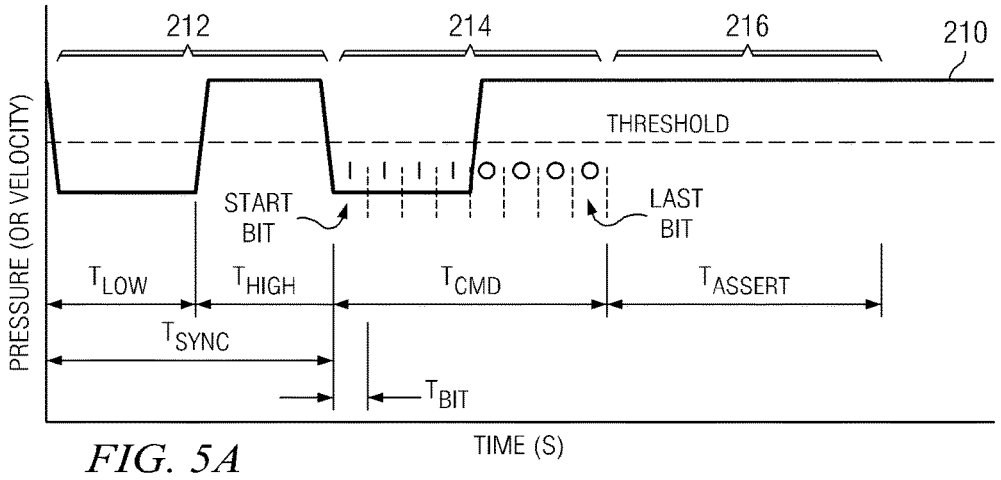
FIGS. 5A and 5B depict exemplary downlinking signal embodiments in accordance with the present invention.

FIG. 5A depicts one exemplary embodiment of a hypothetical downlinking signal 210 in accordance with the present invention (e.g., as transmitted at 204 of FIG. 4). In this particular example, drilling fluid pressure is plotted on the y-axis as a function of time on the x-axis. In the exemplary embodiment depicted, the transmitted signal includes first, second, and third phases; a synchronization phase 212, a command phase 214, and an optional assertion phase 216. The synchronization phase provides for synchronization of surface and downhole systems such that the command phase can be properly decoded. In the exemplary embodiment depicted, the synchronization phase 212 synchronizes the bit length and the pulse depth of the command phase. The synchronization phase 212 may include, for example, a negative pressure pulse for a predetermined period of time $T_{low}$, followed by a return to base pressure (level) for another period of time $T_{high}$. A synchronization time $T_{sync}$ may be defined as the sum of $T_{low}$ and $T_{high}$ as depicted. The synchronization phase 212 may also define the amplitude of the negative pressure pulse $\Delta P$ used in the command phase. Suitable pulse amplitudes are commonly in the range from about 10 to about 40 percent of the base level.

The command phase 214 includes the encoded command (or data). In the exemplary embodiment depicted, the command phase is divided into eight bits (a single start bit and a seven-bit command). It will be understood that the invention is not limited to any particular number of command bits. The bit length $T_{bit}$ may be computed, for example, from $T_{sync}$ (or alternatively from $T_{low}$ and/or $T_{high}$). In the exemplary embodiment depicted, $T_{bit}$ is arbitrarily defined as follows: $T_{bit}=T_{sync}\div 5$. The use of the synchronization phase 212 advantageously enables $T_{bit}$ to be selected based on drilling conditions (e.g., it is often desirable to increase $T_{bit}$ with increasing measured depth of the borehole). Suitable bit lengths are commonly in the range from about 5 to about 30 seconds. The binary value (0 or 1) of each bit may be determined from the measured pressure (or flow rate) during $T_{bit}$ as indicated. In the exemplary embodiment depicted, a value of '0' is assigned to the base level and a value of '1' is assigned to the negative pressure pulse (e.g., a value within a predetermined range of the pressure threshold defined above with respect to Equation 1).

While the invention is not limited to any particular bit length, it will be understood that bit lengths in the range from about 5 to about 30 seconds tend to be advantageous for several reasons. For example, the use of a longer bit length tends to advantageously improve communication accuracy in deeps wells or when downlinking while drilling. Moreover, the use of bit lengths in the above range advantageous enables simultaneous downlinking and uplinking at different frequencies.

With continued reference to FIG. 5A, the assertion phase 216 may be an inactive period (typically at least multiple bits in length, i.e., $T_{assert}\geq 2T_{bit}$) that separates one command block from another. The assertion phase typically indicates the end of the command block.

Figure 5B:
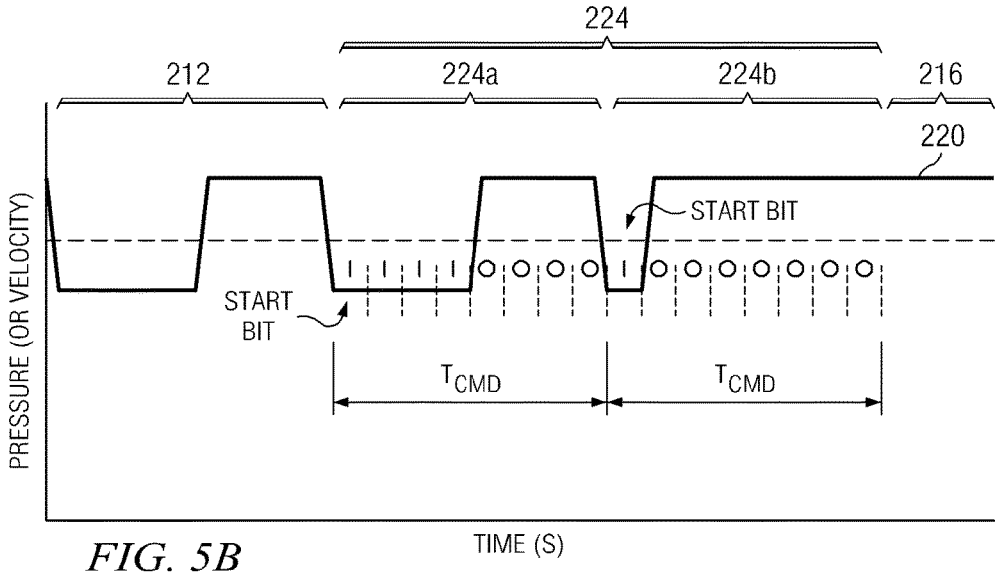

FIG. 5B depicts another exemplary downlinking signal 220 in accordance with the present invention. Downlinking signal 220 is similar to downlinking signal 210 in that it includes synchronization 212, command 224, and assertion 216 phases. Downlinking signal 220 differs from that of downlinking signal 210 in that the command phase 224 includes first and second distinct eight bit commands 224*a* and 224*b* (it will be understood that the command phase may include substantially any number of distinct commands). As depicted, each command preferably includes a start bit. The bit values may be determined as described above (and as indicated).

In the exemplary embodiments depicted on FIGS. 5A and 5B, the command phase includes a seven-bit command. The use of a seven-bit command enables 128 distinct commands to be transmitted downhole. When used in combination with a rotary steering tool, these commands may include, for example, absolute offset, absolute percentage force, absolute toolface angle, absolute target inclination, and absolute target azimuth, absolute dogleg severity, and the like. The commands may further include differential commands, for example including change in offset, change in percentage force, change in toolface angle, change in inclination, change in azimuth, and change in dogleg severity. Other specialized commands may include a vertical command for drilling a vertical section, a build command for building inclination at a constant curvature, a drop command for dropping inclination at a constant curvature, a hold command for maintaining the current inclination, and a cruise command for holding the current inclination and azimuth. The commands typically further include a wake-up command and a blade collapse command. The invention is not limited to any particular commands.

It will be understood that the invention is in no way limited to embodiments in which the command phase includes a seven-bit command. Substantially any bit length may be utilized. For example, a four or five-bit command may be readily utilized for operations in which a well having a relatively simple profile is drilled (e.g., conventional J-shaped or S-shaped wells). These commands may include for example, the differential and specialized commands described above.

As is known to those of ordinary skill in the art, rotary steerable tools (such as steering tool 50 in FIG. 1) commonly include a plurality of blades disposed to extend radially outward into contact with the borehole wall. Engagement of the blades with the borehole wall is intended to deflect the drill string from the central axis of the borehole and thus change the drilling direction. The above described commands are intended to control actuation of the blades and therefore typically cause at extension and/or retraction of at least one blade.

In preferred embodiments of the invention, the most frequently utilized commands (e.g., wake-up, blade collapse, and the like) may be advantageously configured to have the fewest number of fluid pressure or velocity changes (e.g., via valve actuations). When using an eight bit command phase, a rotary steerable wake-up command may given, for example, by the hexadecimal FF (binary 11111111), which requires no valve actuations in the command phase. A rotary steerable blade collapse command may be given, for example, by the hexadecimal F0 (binary 11110000), which requires only a single actuation in the command phase. Other commonly utilized commands may be programmed, for example, using hexadecimal F8, FC, FE, 80, C0, and E0, each of which requires only a single actuation in the command phase. The invention is, of course, not limited in this regard. Minimizing valve and/or pump actuation tends to advantageously also minimize wear to the surface system components (e.g., valve 78 on FIG. 2).

It will be further understood that the invention is not limited to embodiments in which only steering tool commands are downlinked. Those of ordinary skill in the art will readily appreciate that commands may also be downlinked to substantially any downhole tool, for example, including MWD tools, LWD tools, underreamers, packers, fluid sampling devices and the like. For example, downlinking detector 120 (FIGS. 3A and 3B) may be configured to forward commands to the appropriate downhole tool upon receipt. Such forwarding may be accomplished via an intra-tool communication bus, for example, including downhole wired and/or wireless communication networks.

Figure 6A:
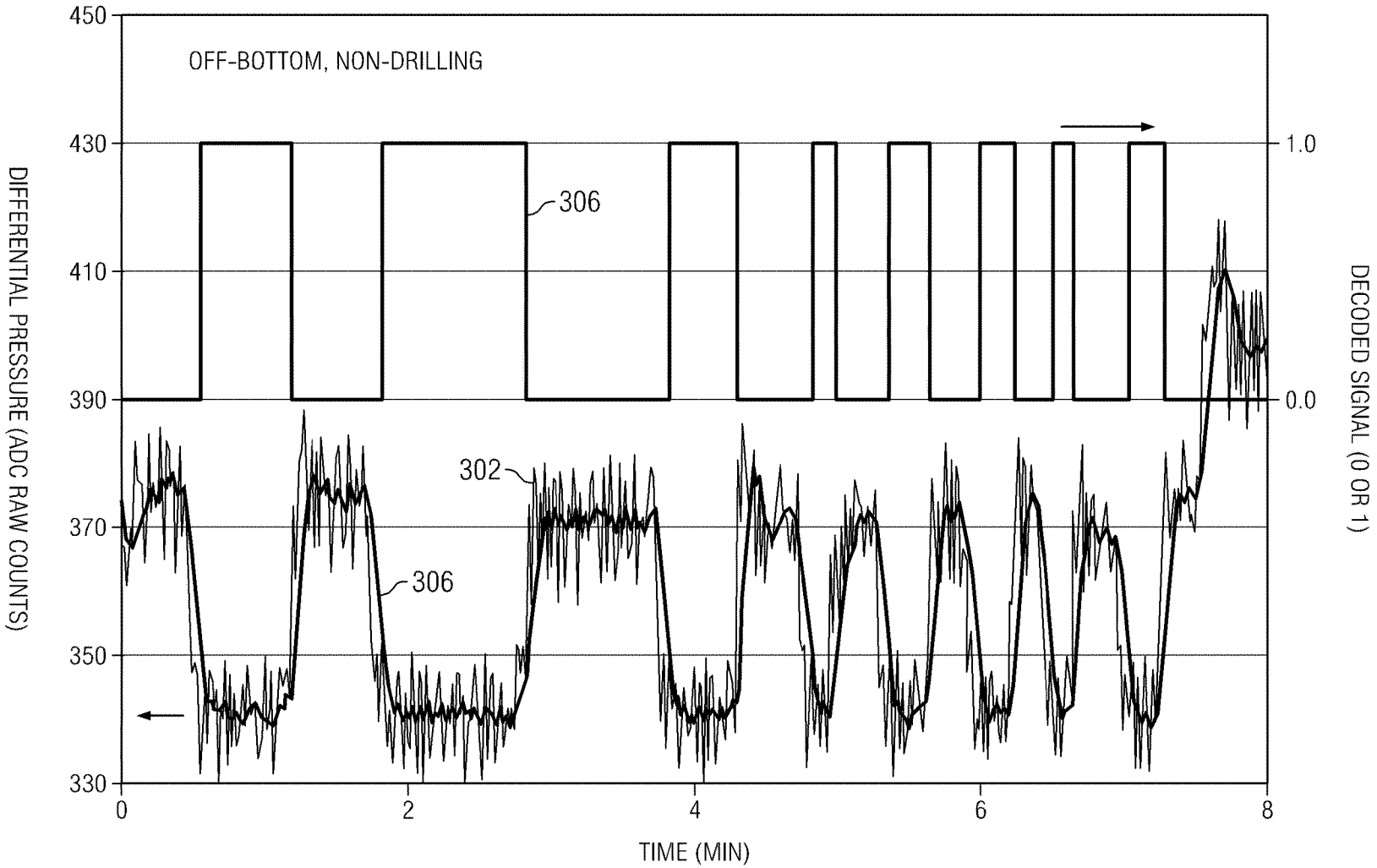
FIGS. 6A and 6B depict test data acquired in a downhole test.
Figure 6B:
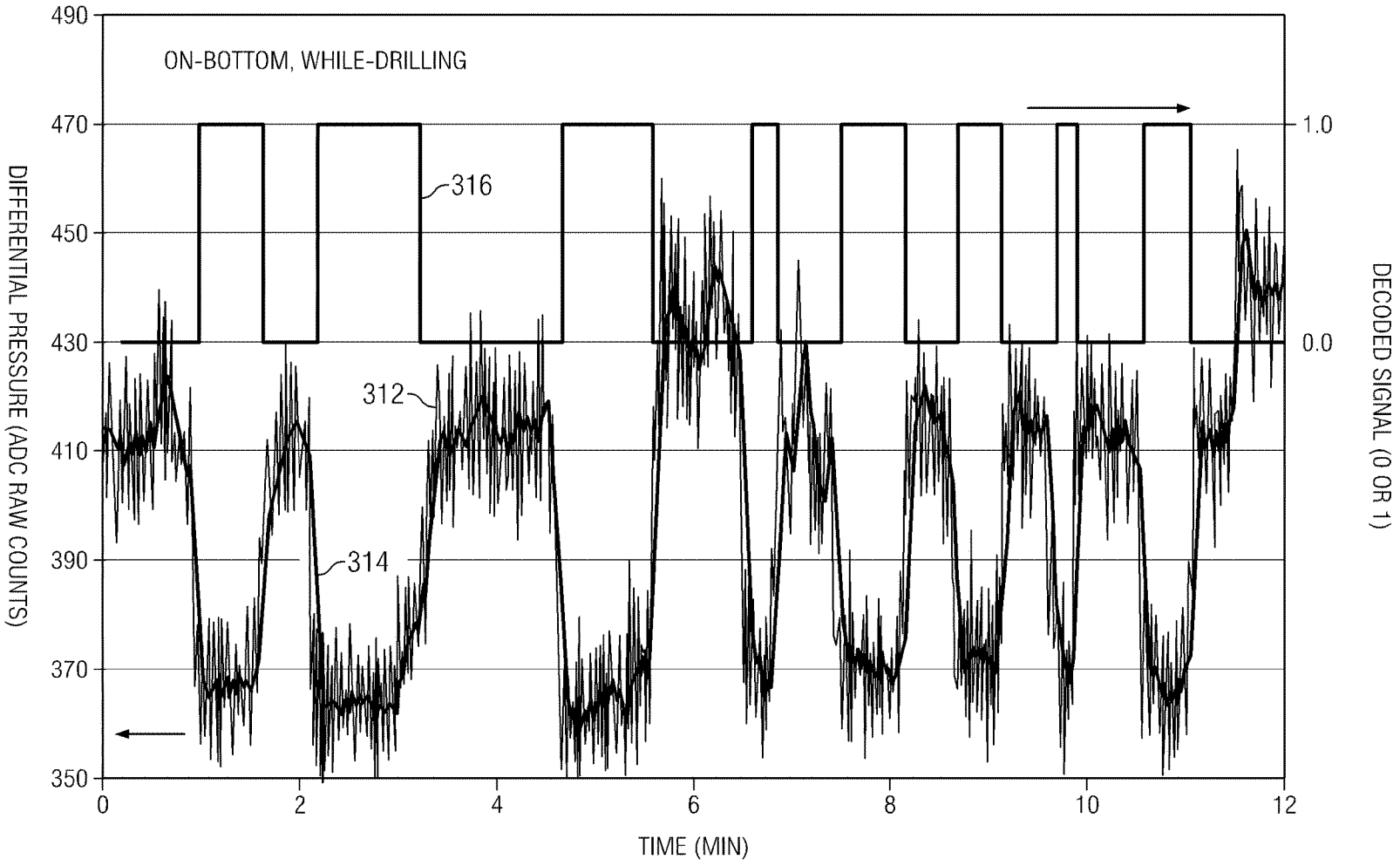

FIGS. 6A and 6B depict detected waveforms and decoded signals for exemplary command signals transmitted downhole. In these exemplary embodiments, the detected signals are filtered using moving average filters. The invention is, of course, not limited in this regard as any known analog and digital filters in the art may be used to remove unwanted noise (such as drilling noise, uplink mud pulse telemetry noise, mud motor noise, etc.). These examples were acquired during a downhole drilling operation in a test well in which negative pressure pulses were propagated downward through drilling fluid in the drill string. In this example, the downlinking detector was deployed in a battery sub located above a rotary steerable tool (e.g., as depicted on FIG. 1). The received waveforms (including a plurality of negative pressure pulses) were transmitted to a controller located in the steering tool. The waveforms were decoded at the steering tool. The invention is of course not limited in these regards.

FIG. 6A depicts a plot of differential pressure (in units of analog to digital converter counts) versus time for an example waveform 302 and 304 and decoded signal 306 acquired during an off-bottom, non-drilling test. The example waveform is shown using standard one second 302 and eight second 304 averaging. The decoded waveform 306 is in conventional binary form in which a high differential pressure is decoded as a '0' and a low differential pressure (the negative pressure pulse) is decoded as a '1'.

FIG. 6B depicts a plot of differential pressure (in units of analog to digital converter counts) versus time for an example waveform 312 and 314 and decoded signal 316 acquired during an on-bottom, while-drilling test. The example waveform is again shown using standard one second 312 and eight second 314 averaging. The decoded waveform 316 is in conventional binary form in which a high differential pressure is decoded as a '0' and a low differential pressure (the negative pressure pulse) is decoded as a '1'. FIGS. 6A and 6B demonstrate that pressure pulses may be readily received and decoded during both non-drilling and while-drilling operations using exemplary embodiments of the present invention.

Although the present invention and its advantages have been described in detail, it should be understood that various changes, substitutions and alternations can be made herein without departing from the spirit and scope of the invention as defined by the appended claims.

I claim:

1. A method for transmitting information from a surface location to a bottom hole assembly located in a borehole, the information including at least one of a command and data, the method comprising:

(a) pumping drilling fluid downhole through a drill string to the bottom hole assembly;

(b) changing a flow rate of the drilling fluid to encode a downlinking signal Comprising at least a synchronization phase and a command phase, each of the synchronization Phase and the command phase including at least one distinct pulse;

(c) detecting the downlinking signal at the bottom hole assembly using a pressure sensor; and (d) decoding the downlinking signal to determine the information.

2. The method of claim 1, wherein the synchronization phase and the command phase each include at least one distinct negative flow rate pulse.

3. The method of claim 1, wherein the synchronization phase includes a negative pulse during a first time period and a return to a base level during a second time period.

4. The method of claim 1, wherein the synchronization phase includes a negative pressure pulse, a level of the negative pressure pulse determining the pulse level of the command phase.

5. The method of claim 1, wherein the bit length is computed from a pulse width of the at least one pulse in the synchronization phase.

6. The method of claim 1, wherein the command phase comprises at least first and second distinct commands, each of the commands including at least four bits.

7. The method of claim 1, wherein the downlinking signal further comprises an assertion phase, the assertion phase indicating the end of the downlinking signal and including a base level signal for a time period of at least twice the bit length of the command phase.

8. The method of claim 1, wherein (a) further comprises rotary drilling the borehole.

9. The method of claim 1, wherein the flow rate is changed in (b) via actuating a bypass valve.

10. The method of claim 1, wherein the flow rate is changed in (b) via changing the rotation speed of a pump.

11. A system for communicating information from a surface location to a bottom hole assembly located in a borehole, the information including at least one of a command and data, the system comprising:

a pump for pumping drilling fluid from the surface through a drill string to the bottom hole assembly;

a flow control apparatus for controlling a flow rate of the drilling fluid, the flow rate encoding a downlinking signal comprising at least a high pressure pulse and a low pressure pulse having a lower pressure that high pressure pulse;

a downhole pressure sensor configured to detect the downlinking signal; and a downhole controlled configured to decode the downlinking signal, wherein each of The high pressure pulse and low pressure pulse is decoded in a binary form, wherein the downlinking signal includes at least a synchronization phase and a command phase, each of the synchronization phase and the command phase including at least one distinct flow rate pulse.

12. The system of claim 11, wherein:

the controller is configured to (i) decode the synchronization phase to determine at least one of a bit length and a pulse level of the command phase and (ii) decode the command phase to determine the information.

13. The system of claim 12, wherein the controller is configured to compute the bit length from a pulse width of a predetermined pulse in the synchronization phase.

14. The system of claim 12, wherein the controller is configured to determine the pulse level of the command phase from a pulse width of a predetermined pulse in the synchronization phase.

15. The system of claim 11, wherein the flow control apparatus is computer controlled.

16. The system of claim 11, wherein the flow control apparatus is configured to selectively open and close a bypass valve, wherein opening the bypass valve reduces the flow rate in the drill string.

17. The system of claim 11, wherein the flow control apparatus is configured to control the rotation rate of the pump.

18. The system of claim 11, wherein the detector comprises at least one of an absolute pressure sensor configured to measure pressure of drilling fluid in the drill string and a differential transducer configured to measure a pressure differential between drilling fluid in the drill string and drilling fluid in a borehole annulus.

19. The system of claim 11, further comprising a rotary steerable tool configured to execute the command, the command being selected from the group consisting of absolute offset, absolute percentage force, absolute toolface angle, absolute target inclination, absolute target azimuth, absolute dogleg severity, change in offset, change in percentage force, change in toolface angle, change in inclination, change in azimuth, and change in dogleg severity.

* * * * *